US005542618A

United States Patent [19]

Andersen

[11] Patent Number: 5,542,618

[45] Date of Patent: Aug. 6, 1996

[54] ROLLER PRESS

[75] Inventor: Knud T. Andersen, Copenhagen, Denmark

[73] Assignee: F. L. Smidth & Co. A/S, Denmark

[21] Appl. No.: 30,220

[22] PCT Filed: Jan. 23, 1992

[86] PCT No.: PCT/EP92/00141

§ 371 Date: Mar. 23, 1993

§ 102(e) Date: Mar. 23, 1993

[87] PCT Pub. No.: WO92/13639

PCT Pub. Date: Aug. 20, 1992

[30] Foreign Application Priority Data

Feb. 7, 1991 [GB] United Kingdom ..... 9102623

[51] Int. Cl.[6] ..... B02C 4/32

[52] U.S. Cl. ..... 241/227; 241/232; 241/234

[58] Field of Search ..... 241/227, 230, 241/231, 232, 233, 234, 101.2

[56] References Cited

U.S. PATENT DOCUMENTS

| | | | |
|---|---|---|---|
| 4,154,408 | 5/1979 | Boling, Jr. | 241/231 |
| 4,168,806 | 9/1979 | Jakobs | 241/232 |
| 4,880,172 | 11/1989 | Heinemann et al. | 241/101.2 |
| 5,005,775 | 4/1991 | Jakobs | 241/232 |
| 5,031,845 | 7/1991 | Gemsjager | 241/78 |
| 5,154,364 | 10/1992 | Ketting | 241/37 |
| 5,192,030 | 3/1993 | Jakobs | 241/101.2 |

FOREIGN PATENT DOCUMENTS

| | | | |
|---|---|---|---|
| 0280897 | 9/1988 | European Pat. Off. . | |
| 2641713 | 7/1990 | France . | |
| 2704243 | 8/1978 | Germany . | |
| 3723605 | 1/1989 | Germany . | |
| 0272611 | 10/1989 | Germany | 241/231 |
| 4019363 | 8/1991 | Germany . | |

*Primary Examiner*—John Husar

*Attorney, Agent, or Firm*—Brumbaugh, Graves, Donohue & Raymond

[57] ABSTRACT

A roller press comprising two rollers which rotate in opposite rotational directions, the rollers being driven via two gear units mounted on the roller shafts and having means for counterbalancing the oppositely-directed torques arising in the gear units in the form of a torque reaction system, eliminating the need for a torque absorption mechanism attached to the machine frame of the roller press.

4 Claims, 2 Drawing Sheets

ROLLER PRESS

BACKGROUND OF THE INVENTION

The present invention relates to a roller press of the kind (hereinafter referred to as of the kind described) comprising two rollers which have a variable nip width and which are driven in opposite rotational directions via two reduction gear units each of which is mounted on a separate shaft for a respective one of the rollers, the gear units having a torque reaction system, In known roller presses of the above kind, each gear unit is normally connected to the foundation or the machine frame by means of a single torque arm. This, however, involves the disadvantage that the torques are transformed into reaction forces, causing high loads in the gear unit bearings and bending of the roller shafts.

Therefore, owing to the significant torques and torque variations generally occurring in roller presses, it is advantageous to utilize a dual arm reaction system with the capability of directly balancing the torques without generating reaction forces causing high loads in the bearings.

A roller press of the this kind is known from EP-A-0280897 where the torques occurring in the two gear units are substantially balanced against each other, so that any differential torque, arising as a result of a numerical difference between the two torques, is absorbed by a single torque arm fixed between one gear unit and the foundation or the machine frame of the roller press. This reaction system is of a relatively complex construction in that it requires a torsion shaft, supported by bearings on the fixed gear unit, and pivotally connected at each end to a coupling means, which in turn is connected to the movable gear unit. Each coupling means for the displaceable gear unit is connected to the torsion shaft by means of a coupling arm so that the torque from the displaceable gear unit produces oppositely-directed torsion of the torsion shaft. As a consequence thereof, the system is relatively expensive, both in terms of manufacture and maintenance. Another inherent weakness of that system is the need for an additional torque arm which is attached to the foundation or the machine frame in order to absorb a potential differential torque arising as a result of a difference in torques in the two gear units.

It is the object of the invention to provide a reaction system for a roller press of the kind described whereby the need for a torque absorption mechanism attached to the machine frame is eliminated, with the added benefit that the system is simple and cheap to manufacture and maintain in comparison with the known system.

SUMMARY OF THE INVENTION

According to the invention, this object is achieved if the torque reaction system of a roller press of the kind described comprises two pairs of arms, each pair being rigidly connected to a respective one of the gear units, and each arm of one pair being coupled with a respective one of the arms of the other pair so as to transmit therebetween torque-generated forces acting substantially perpendicularly to the plane containing the roller axes, while permitting mutual reciprocal movement of the rollers in that plane.

By providing the arms on the gear units in such a manner that the couplings only have the capability to absorb forces in a direction substantially perpendicular to the plane, which includes the rotational axes of the rollers, the effect is achieved that a differential torque, if any, can be absorbed by the shaft bearings for the roller shafts. This is due to the fact that, by virtue of the special construction according to the invention, a potential differential torque is transformed into a pure push-pull force component which, without any significant increase in the load capacity of the bearings, can be absorbed by the latter.

The couplings may comprise a pair of rigid connecting rods, each of which is pivotally connected at its ends to respective arms of respective ones of the gear units.

Alternatively, the couplings may comprise a pair of planar slide or roller bearings, each mounted between two arms, one from each gear unit.

BRIEF DESCRIPTION OF THE DRAWINGS

The invention is now described by the way of example with reference to the accompanying drawings in which.

In the figures, which are diagrammatic, all parts of the roller press of no significance to the present invention are omitted.

DESCRIPTION OF THE PREFERRED EMBODIMENT

Figure 1:
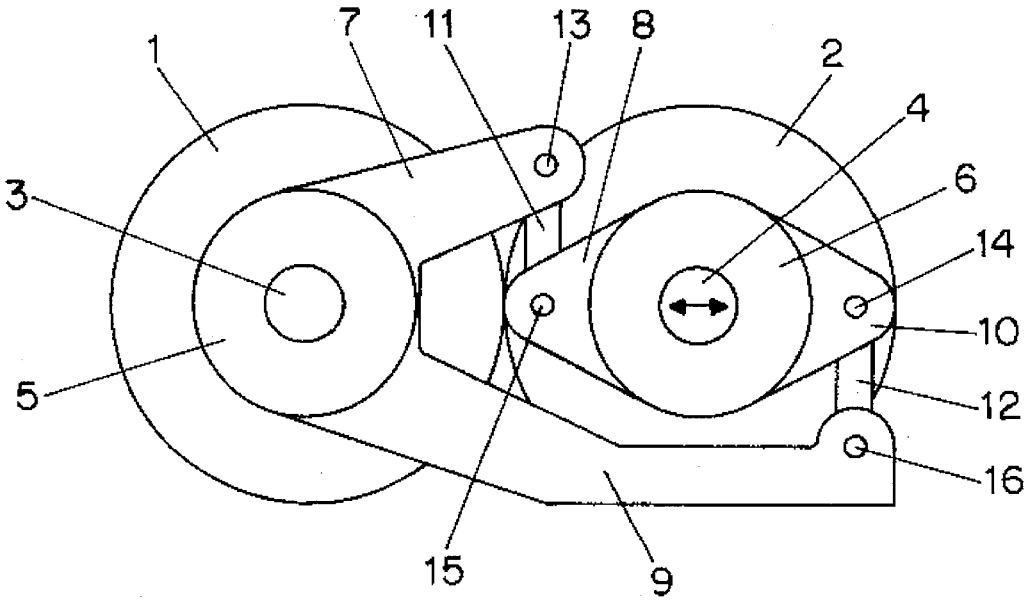
FIG. 1 is a side view of a first example of a roller press according to the invention having a torque reaction system in which the couplings comprise connecting rods.
Figure 2:
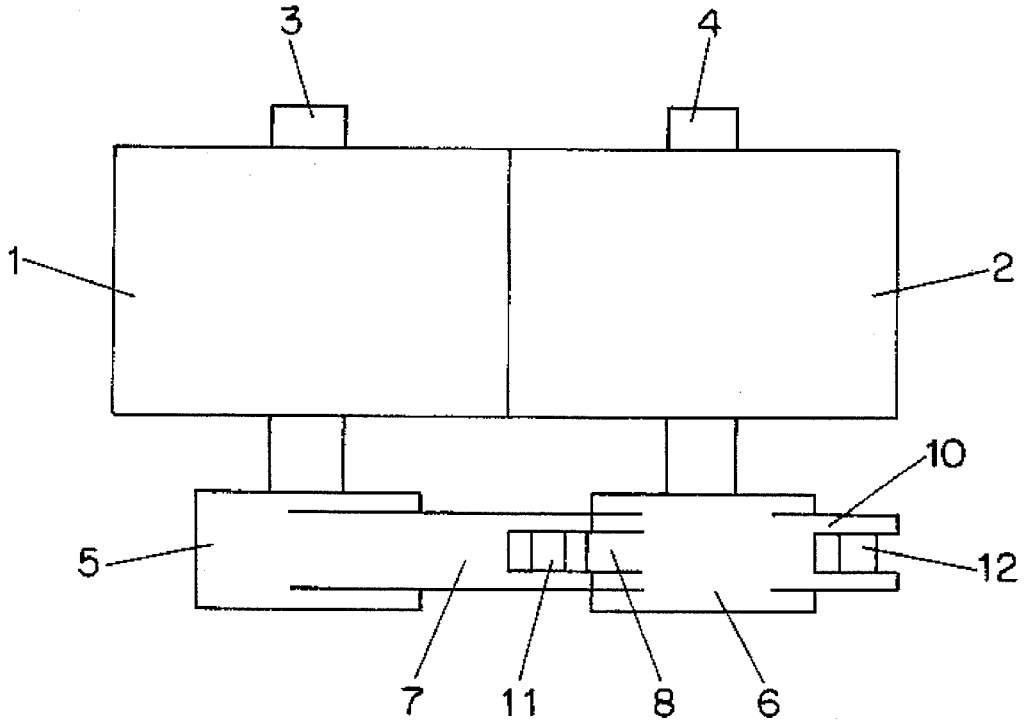
FIG. 2 is a plan of the example illustrated in FIG. 1.

The roller press shown in FIGS. 1 and 2 comprises two rollers 1, 2, of which the axis of one roller 1 is stationary, whereas the second roller 2 is movable relatively to the first roller 1, being urged against the latter by means of for example hydraulic cylinders, not shown. The rollers are rotatable in opposite directions by means of their separate roller shafts 3, 4, which are rotably mounted in the machine frame of the roller press (not shown), and are driven via two gear units 5, 6 mounted on separate roller shafts. Each gear unit 5, 6 has two rigid arms 7, 9, and 8, 10 respectively, the arms being inter-connected in pairs by means of connecting rods 11, 12 pivotally mounted on the arms at 13, 15, and 14, 16 respectively.

The gear units with the arms 7, 9 and 8, 10 respectively connected in pairs to the connecting rods 11, 12, will act as a reaction system for the torques acting upon the gear units.

In operation, the torques developed in the gear units as a consequence of the frictional force between the rollers will hence counterbalance each other. If the torques in the gear units 5, 6 are of the same numerical size, the force in the connecting rods 11, 12 will be equal to the torque divided by the distance between the connecting rods. However, in event of a difference, normally minor, between the torques, such difference will be equalized by reactions in the roller shafts, with the reactions being equal to the difference between the torques divided by the distance between the roller axes.

Figure 3:
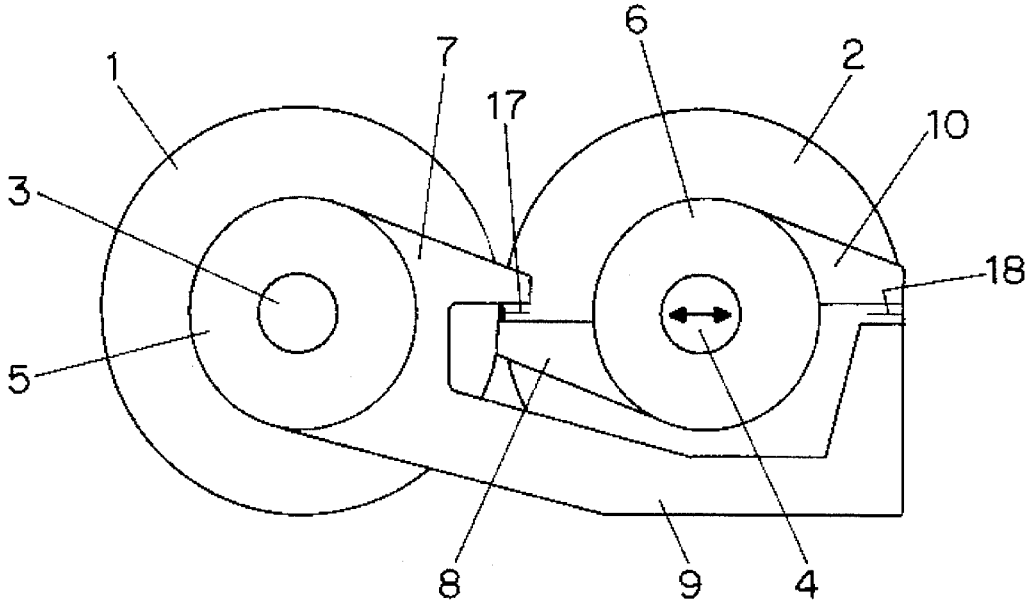
FIG. 3 shows a second example of a roller press according to the invention having a torque reaction system in which the couplings comprise slide bearings or roller bearings; and, FIG. 4 is a side view of a third example of a roller press according to the invention in which the couplings comprise connecting rods.

FIG. 3 shows a different reaction system for a roller press which is identical to that illustrated in FIG. 1 and 2. In this example, the couplings comprise plane slide and/or roller bearings 17, 18. The details incorporated in the construction of bearings are not shown in the figure, but they have to be so configured that they permit movement of the roller 2 with gear unit 4 in direction towards and away from roller 1 with the gear unit 3. This movement of the roller 2 is shown in FIG. 1, 3 and 4 by means of a double arrow.

Figure 4:
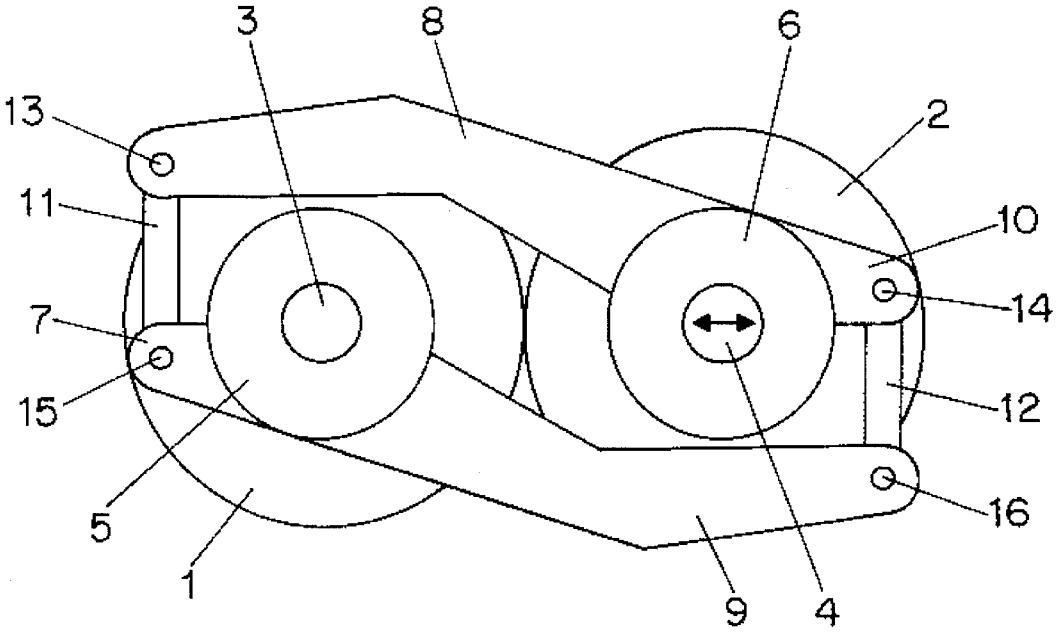

Another example of a reaction system according to the invention is shown in FIG. 4. This arrangement is especially preferred since it eliminates the space problem which may occur when mounting the coupling between the gear units 5, 6 as according to the former examples. By providing the connections between the arms at a distance from the roller shafts relative to the mutual line of contact between the rollers, this eliminates the need for more space between the gear units, which space is often restricted.

The couplings for the example shown in FIG. 4 do not necessarily incorporate connecting rods, as shown, but may also be substituted by slide or roller bearings.

I claim:

1. A roller press comprising two rollers, said rollers having a variable width nip between them, said rollers further being driven in opposite rotational directions by two reduction gear units each mounted on a separate shaft for a respective one of the rollers, said gear units including torque reaction means for causing torque-generated forces on the gear units to act substantially perpendicularly to the plane containing the roller axes, while permitting mutual reciprocal movement of the rollers in the plane, said torque reaction means comprising two pairs of arms, each pair being rigidly connected to a respective one of the gear units, and each arm of one pair being coupled with a respective one of the arms of the other pair.

2. A press according to claim 1, wherein the couplings comprise a pair of rigid connecting rods (11, 12), each of which is pivotally connected at its ends to respective arms of respective ones of the gear units.

3. A roller press according to claim 1, wherein the couplings comprise a pair of planar slide bearings (17, 18), each mounted between two arms, one from each gear unit.

4. A roller press according to claim 1, wherein the couplings comprise a pair of planar roller bearings (17, 18), each mounted between two arms, one from each gear unit.

* * * * *